US007252750B2

(12) United States Patent
Liu et al.

(10) Patent No.: US 7,252,750 B2
(45) Date of Patent: Aug. 7, 2007

(54) DUAL CONTACT RING AND METHOD FOR METAL ECP PROCESS

(75) Inventors: Chi-Wen Liu, Hsinchu (TW); Jung-Chih Tsao, Taipei (TW); Ke-Wei Chen, Taipei (TW); Ying-Lang Wang, Taichung (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 869 days.

(21) Appl. No.: 10/664,347

(22) Filed: Sep. 16, 2003

(65) Prior Publication Data

US 2005/0056544 A1 Mar. 17, 2005

(51) Int. Cl.
*C25D 17/00* (2006.01)

(52) U.S. Cl. ..... 205/80; 204/224 R; 204/279; 204/297.01; 204/DIG. 7; 205/87; 205/96; 205/123; 205/223

(58) Field of Classification Search ..... 204/224 R, 204/279, 297.01, DIG. 7; 205/80, 87, 96, 205/123, 223

See application file for complete search history.

(56) References Cited

U.S. PATENT DOCUMENTS

| | | | | |
|---|---|---|---|---|
| 6,251,236 | B1 * | 6/2001 | Stevens | 204/224 R |
| 6,277,336 | B1 * | 8/2001 | Henrich et al. | 422/186.07 |
| 6,444,101 | B1 * | 9/2002 | Stevens et al. | 204/224 R |
| 6,773,560 | B2 * | 8/2004 | Pedersen et al. | 204/224 R |
| 7,087,144 | B2 * | 8/2006 | Herchen | 204/297.1 |

* cited by examiner

*Primary Examiner*—Roy King
*Assistant Examiner*—William T. Leader
(74) *Attorney, Agent, or Firm*—Tung & Associates

(57) ABSTRACT

A dual contact ring for contacting a patterned surface of a wafer and electrochemical plating of a metal on the patterned central region of the wafer and removing the metal from the outer, edge region of the wafer. The dual contact ring has an outer voltage ring in contact with the outer, edge region of the wafer and an inner voltage ring in contact with the inner, central region of the wafer. The outer voltage ring is connected to a positive voltage source and the inner voltage ring is connected to a negative voltage source. The inner voltage ring applies a negative voltage to the wafer to facilitate the plating of metal onto the patterned region of the wafer. A positive voltage is applied to the wafer through the outer voltage ring to remove the plated metal from the outer, edge region of the substrate.

20 Claims, 2 Drawing Sheets

DUAL CONTACT RING AND METHOD FOR METAL ECP PROCESS

FIELD OF THE INVENTION

The present invention relates to electrochemical plating processes for depositing metal layers such as copper on semiconductor wafer substrates. More particularly, the present invention relates to a dual contact ring and method for plating a metal onto a selected region or regions of a wafer and removing the plated metal from other regions of the wafer.

BACKGROUND OF THE INVENTION

The fabrication of various solid state devices requires the use of planar substrates, or semiconductor wafers, on which integrated circuits are fabricated. The final number, or yield, of functional integrated circuits on a wafer at the end of the IC fabrication process is of utmost importance to semiconductor manufacturers, and increasing the yield of circuits on the wafer is the main goal of semiconductor fabrication. After packaging, the circuits on the wafers are tested, wherein non-functional dies are marked using an inking process and the functional dies on the wafer are separated and sold. IC fabricators increase the yield of dies on a wafer by exploiting economies of scale. Over 1000 dies may be formed on a single wafer which measures from six to twelve inches in diameter.

Various processing steps are used to fabricate integrated circuits on a semiconductor wafer. These steps include deposition of a conducting layer on the silicon wafer substrate; formation of a photoresist or other mask such as titanium oxide or silicon oxide, in the form of the desired metal interconnection pattern, using standard lithographic or photolithographic techniques; subjecting the wafer substrate to a dry etching process to remove the conducting layer from the areas not covered by the mask, thereby etching the conducting layer in the form of the masked pattern on the substrate; removing or stripping the mask layer from the substrate typically using reactive plasma and chlorine gas, thereby exposing the top surface of the conductive interconnect layer; and cooling and drying the wafer substrate by applying water and nitrogen gas to the wafer substrate.

The numerous processing steps outlined above are used to cumulatively apply multiple electrically conductive and insulative layers on the wafer and pattern the layers to form the circuits. The final yield of functional circuits on the wafer depends on proper application of each layer during the process steps. Proper application of those layers depends, in turn, on coating the material in a uniform spread over the surface of the wafer in an economical and efficient manner.

In the semiconductor industry, copper is being increasingly used as the interconnect material for microchip fabrication. The conventional method of depositing a metal conducting layer and then etching the layer in the pattern of the desired metal line interconnects and vias cannot be used with copper because copper is not suitable for dry-etching. Special considerations must also be undertaken in order to prevent diffusion of copper into silicon during processing. Therefore, the dual-damascene process has been developed and is widely used to form copper metal line interconnects and vias in semiconductor technology. In the dual-damascene process, the dielectric layer rather than the metal layer is etched to form trenches and vias, after which the metal is deposited into the trenches and vias to form the desired interconnects. Finally, the deposited copper is subjected to chemical mechanical planarization (CMP) to remove excess copper (copper overburden) extending from the trenches.

A significant advantage of the dual-damascene process is the creation of a two-leveled metal inlay which includes both via holes and metal line trenches that undergo copper fill at the same time. This eliminates the requirement of forming the trenches for the metal interconnect lines and the holes for the vias in separate processing steps. The process further eliminates the interface between the vias and the metal lines.

Another important advantage of the dual-damascene process is that completion of the process typically requires 20% to 30% fewer steps than the traditional aluminum metal interconnect process. Furthermore, the dual damascene process omits some of the more difficult steps of traditional aluminum metallization, including aluminum etch and many of the tungsten and dielectric CMP steps. Reducing the number of process steps required for semiconductor fabrication significantly improves the yield of the fabrication process, since fewer process steps translate into fewer sources of error that reduce yield.

Electroplated copper provides several advantages over electroplated aluminum when used in integrated circuit (IC) applications, including dual damascene applications. Copper is less electrically resistive than aluminum and is thus capable of higher frequencies of operation. Furthermore, copper is more resistant to electromigration (EM) than is aluminum. This provides an overall enhancement in the reliability of semiconductor devices because circuits which have higher current densities and/or lower resistance to EM have a tendency to develop voids or open circuits in their metallic interconnects. These voids or open circuits may cause device failure or burn-in.

FIG. 1 schematically illustrates a typical standard or conventional electrochemical plating (ECP) system 10 for depositing copper onto a semiconductor wafer 18. The ECP system 10 includes a standard electroplating cell having an adjustable current source 12, a bath container 14, a copper anode 16 and a cathode 18, which cathode 18 is the semiconductor wafer that is to be electroplated with copper. The anode 16 and semiconductor wafer/cathode 18 are connected to the current source 12 by means of suitable wiring 38. The bath container 14 holds a bath 20 typically of acid copper sulfate solution which may include an additive for filling of submicron features and leveling the surface of the copper electroplated on the wafer 18.

As illustrated in FIGS. 1 and 2, the ECP system 10 typically further includes a pair of bypass filter conduits 24 which extend through the anode 16 and open to the upper, oxidizing surface 22 of the anode 16 at opposite ends of the anode 16. The bypass filter conduits 24 connect to a bypass pump/filter 30 located outside the bath container 14, and the bypass pump/filter 30 is further connected to an electrolyte holding tank 34 through a tank inlet line 32. The electrolyte holding tank 34 is, in turn, connected to the bath container 14 through a tank outlet line 36.

In operation of the ECP system 10, the current source 12 applies a selected voltage potential typically at room temperature between the anode 16 and the cathode/wafer 18. This potential creates a magnetic field around the anode 16 and the cathode/wafer 18, which magnetic field affects the distribution of the copper ions in the bath 20. In a typical copper electroplating application, a voltage potential of about 2 volts may be applied for about 2 minutes, and a current of about 4.5 amps flows between the anode 16 and the cathode/wafer 18. Consequently, copper is oxidized typically at the oxidizing surface 22 of the anode 16 as electrons from the copper anode 16 reduce the ionic copper in the copper sulfate solution bath 20 to form a copper electroplate (not illustrated) at the interface between the cathode/wafer 18 and the copper sulfate bath 20.

The copper oxidation reaction which takes place at the oxidizing surface 22 of the anode 16 is illustrated by the following reaction formula (1):

$$Cu - - - > Cu^{++} + 2e- \quad (1)$$

The oxidized copper cation reaction product forms ionic copper sulfate in solution with the sulfate anion in the bath 20:

$$Cu^{++} + SO_4^{--} - - - > Cu^{++}SO_4^{--} \quad (2)$$

At the cathode/wafer 18, the electrons harvested from the anode 16 flow through the wiring 38 and reduce copper cations in solution in the copper sulfate bath 20 to electroplate the reduced copper onto the cathode/wafer 18:

$$Cu^{++} + 2e- - - - > Cu \quad (3)$$

Throughout the copper ECP process, the copper is deposited on all areas of the wafer surface, as well as the wafer edge. Thus, a wafer edge removal process, commonly known as IBC (Integrated Bevel Clean), is typically carried out on the wafer to remove the excess electroplated copper from the edge of the wafer. Typically, the IBC module in which the edge removal process is carried out is integrated into the ECP machine which contains the ECP bath in which the electrochemical copper plating process is carried out. However, the IBC module occupies a relatively large footprint in the semiconductor fabrication facility. Furthermore, because the IBC process is separate from the the ECP process, the electroplated wafers must be individually transported from the ECP bath to the IBC module, and this adversely affects wafer throughput. Accordingly, a device and method is needed for preventing electroplating of copper or other metal on the edge of a wafer to eliminate the need for the IBC process to be carried out on the wafer after the ECP process.

An object of the present invention is to provide a novel dual contact ring for removing metal electrochemically plated onto the outer, edge region of a substrate while facilitating plating of the metal onto the inner, central region of the substrate.

Another object of the present invention is to provide a novel dual contact ring which enhances wafer throughput in the fabrication of semiconductor integrated circuits.

Still another object of the present invention is to provide a novel dual contact ring which enhances space utilization in a semiconductor fabrication facility.

Yet another object of the present invention is to provide a novel dual contact ring which may include an outer voltage ring for contacting the edge regions of a substrate, an inner voltage ring for contacting the central regions of the substrate, and a voltage source connected to the outer voltage ring and the inner voltage ring for applying a positive voltage to the outer voltage ring and a negative voltage to the inner voltage ring.

A still further object of the present invention is to provide a method for plating a metal onto the central, patterned region of a substrate and de-plating a metal from the outer, edge region of a substrate.

SUMMARY OF THE INVENTION

In accordance with these and other objects and advantages, the present invention is generally directed to a novel dual contact ring for contact with a patterned surface of a wafer and promoting electrochemical plating of a metal such as copper on the patterned central region of the wafer and deplating or removing the metal from the outer, edge region of the wafer. The dual contact ring may include an outer voltage ring which is provided in contact with the outer, edge region of the wafer and an inner voltage ring which is provided in contact with the inner, central region of the wafer. The outer voltage ring is typically connected to a positive voltage source and the inner voltage ring is typically connected to a negative voltage source. During the electroplating process, the inner voltage ring applies a negative voltage to the wafer to facilitate the plating of metal onto the central, patterned region of the wafer. A positive voltage is then applied to the wafer through the outer voltage ring to remove the plated metal from the outer, edge region of the substrate.

The present invention further includes a method for removing an electrochemically-plated metal typically from the edge region of a substrate after an ECP process. In a preferred embodiment of the method, a negative voltage is first applied to the central, patterned region of the substrate to electroplate the metal onto the central region of the substrate, after which a positive voltage is applied to the outer, edge region. Accordingly, any metal previously deposited onto the outer edge region of the substrate is de-plated or removed from that region of the substrate. Alternatively, the electroplated metal can be removed from the edge region of the substrate as the metal is electroplated onto the central region of the substrate. Deplating of the metal from the edge region of the substrate eliminates the need for subjecting the substrate to a post-ECP edge removal process such as IBC (Integrated Bevel Clean).

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
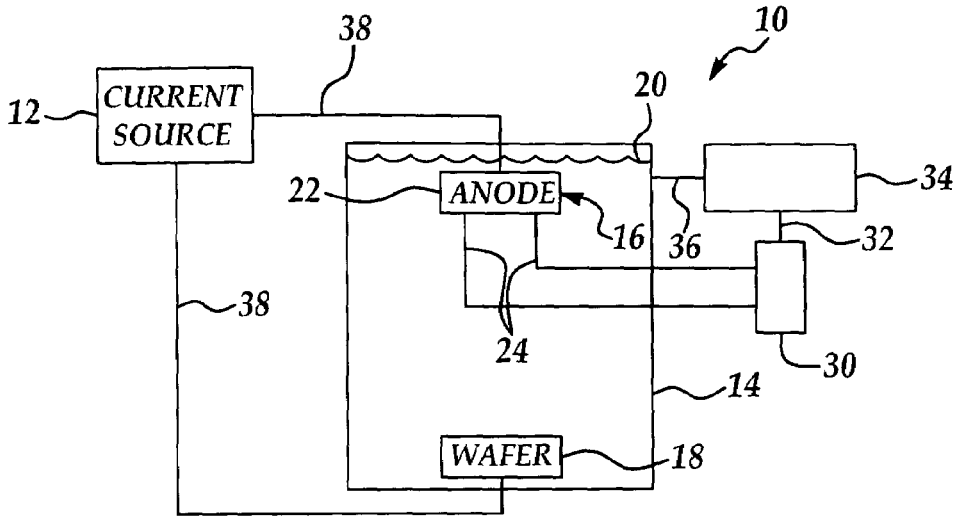
Figure 1 Prior Art
FIG. 1 is a schematic view of a typical conventional electrochemical plating (ECP) system.

The present invention has particularly beneficial utility in removing copper electroplated onto the outer, edge region of a semiconductor wafer substrate during or after electroplating of the copper on the central, patterned region on the substrate in the fabrication of integrated circuits on the substrate. However, the invention is more generally applicable to electroplating copper or other metals such as aluminum, nickel, chromium, zinc, tin, gold, silver, lead and cadmium on substrates in a variety of mechanical and industrial applications. The present invention is also applicable to electroplating alloys of metals on substrates.

The present invention includes a novel dual contact ring for contacting a patterned surface of a wafer and removing a metal such as copper from the edge regions of the wafer as or after the metal is electroplated onto the central patterned region of the wafer. The dual contact ring typically includes concentric outer and inner voltage rings which are provided in contact with the outer, edge region and the inner, central or patterned region, respectively, of the wafer. The outer and inner voltage rings are connected to positive and negative voltage sources, respectively. After the copper or other metal is electroplated onto the substrate wafer by the application of a negative voltage to the inner voltage ring, a positive voltage is applied through the outer voltage ring to the wafer to remove the electroplated metal from the wafer edge region. Alternatively, the negative and positive voltages may be simultaneously applied to the outer and inner voltage rings, respectively, for the simultaneous electroplating of the metal onto the central region and removal of the metal from the outer region. It is understood that the voltage rings may be selectively configured for contact with selected areas on the substrate to facilitate electroplating of the metal onto some areas on the substrate and de-plating of the metal from other areas on the substrate.

The present invention further includes a method for removing an electroplated metal such as copper from the edge region of a substrate during or after an ECP (electrochemical plating) process. In a preferred embodiment, the method includes application of a negative voltage to the inner, patterned region of the substrate, followed by or simultaneous with application of a positive voltage to the outer, edge region of the substrate. The negative voltage applied to the inner, patterned region of the substrate facilitates reduction of the metal cations and electroplating of the reduced metal onto the central region of the substrate. The positive voltage applied to the outer region of the substrate facilitates removal of the electroplated metal from the edge region.

In a most preferred embodiment, the method includes application of a negative voltage to the inner or central patterned region of the substrate for a period of from typically about 2 minutes to about 8 minutes, and preferably, about 5 minutes during the ECP process. The negative voltage is of a magnitude on the order of typically from about −10 to about −20 volts. A positive voltage is applied to the outer or edge region of the substrate for a period of typically from about 5 minutes to about 10 minutes, and preferably, about 7 minutes either during or after the ECP process. The positive voltage is of a magnitude on the order of typically from about +10 to about +20 volts.

In a most preferred aspect of the invention, the method includes the steps of providing concentric outer and inner voltage rings in contact with outer and inner regions, respectively, of a substrate; connecting the outer and inner voltage rings to voltage sources; immersing the outer and inner voltage rings, with the substrate, in an ECP electrolyte bath; applying a negative voltage to the inner voltage ring to electroplate the substrate with a metal such as copper; and applying a positive voltage to the outer voltage ring to remove the electroplated copper from the edge region of the substrate.

The process of the invention may be used with any electroplating bath formulation, such as copper, aluminum, nickel, chromium, zinc, tin, gold, silver, lead and cadmium electroplating baths. The present invention is also suitable for use with electroplating baths containing mixtures of metals to be plated onto a substrate. It is preferred that the electroplating bath be a copper alloy electroplating bath, and more preferably, a copper electroplating bath. Typical copper electroplating bath formulations are well known to those skilled in the art and include, but are not limited to, an electrolyte and one or more sources of copper ions. Suitable electrolytes include, but are not limited to, sulfuric acid, acetic acid, fluoroboric acid, methane sulfonic acid, ethane sulfonic acid, trifluormethane sulfonic acid, phenyl sulfonic acid, methyl sulfonic acid, p-toluenesulfonic acid, hydrochloric acid, phosphoric acid and the like. The acids are typically present in the bath in a concentration in the range of from about 1 to about 300 g/L. The acids may further include a source of halide ions such as chloride ions. Suitable sources of copper ions include, but are not limited to, copper sulfate, copper chloride, copper acetate, copper nitrate, copper fluoroborate, copper methane sulfonate, copper phenyl sulfonate and copper p-toluene sulfonate. Such copper ion sources are typically present in a concentration in the range of from about 10 to about 300 g/L of electroplating solution.

Figure 4:
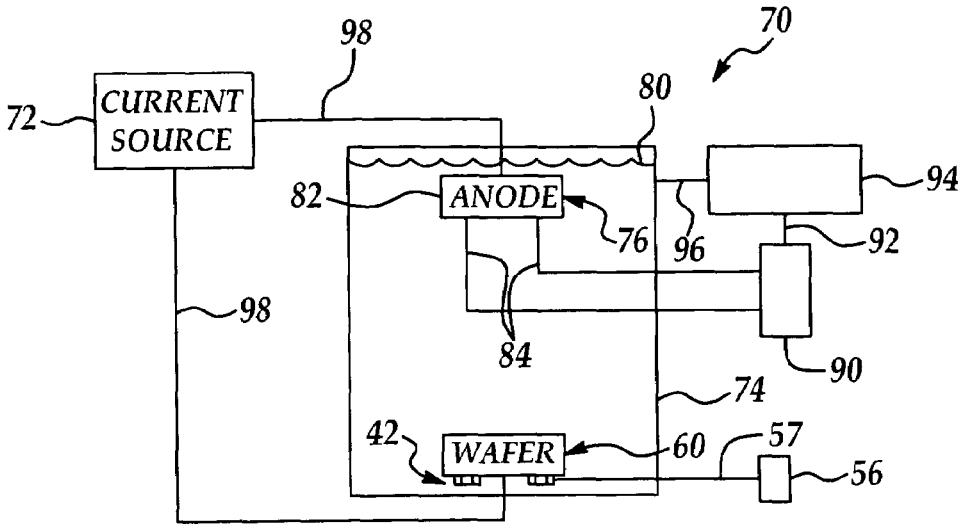
FIG. 4 is a schematic view of an ECP system in implementation of the dual contact ring of the present invention.

Referring initially to FIG. 4, a schematic of an electrochemical plating system 70 which is suitable for implementation of the present invention is shown. The electroplating system 70 typically includes a bath container 74 in which a typically copper anode 76 and a cathode 60 are placed, the cathode 60 being the semiconductor wafer that is to be electroplated with copper. An adjustable current source 72 is connected to the anode 76 and to the semiconductor wafer/cathode 60 through suitable wiring 98. The bath container 74 holds an electroplating bath 80 typically of acid copper sulfate ($CuSO_4$) solution, for example, which may include an additive for filling of submicron features and leveling the surface of the copper electroplated on the wafer 60, as is known by those skilled in the art. A pair of bypass filter conduits 84 extends through the anode 76 and each opens to the upper, oxidizing surface 82 of the anode 76. A bypass pump/filter 90 located outside the bath container 74 is connected to the bypass filter conduits 84, and an electrolyte holding tank 94 may be connected to the bypass pump/filter 90 through a tank inlet line 92. A tank outlet line 96 in turn connects the electrolyte holding tank 94 to the bath container 74. The electrolyte content of the bath 80 can typically be increased, as needed, by adding electrolytes to the electrolyte holding tank 94 and then circulating the bath 80 through the bypass filter conduits 84, the bypass pump/filter 90, the tank inlet line 92, the electrolyte holding tank 94 and back into the bath container 74 through the tank outlet line 96, respectively. It is understood that the ECP system 70 heretofore described represents just one example of a possible system which is suitable for implementation of the present invention, and other systems of alternative design may be used instead.

Figure 2:
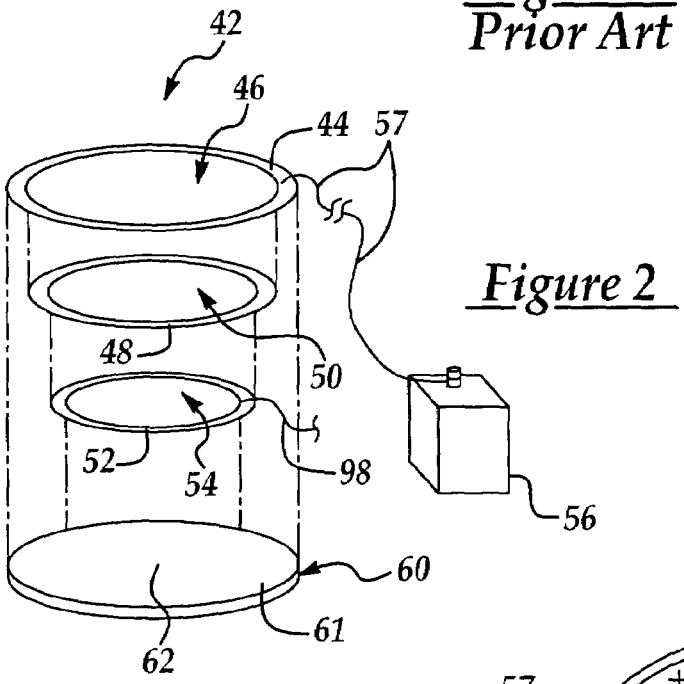
FIG. 2 is an exploded, perspective view of a dual contact ring of the present invention.

Referring next to FIG. 2, an illustrative embodiment of the dual contact ring of the present invention is generally indicated by reference numeral 42. The dual contact ring 42 includes an outer voltage ring 44 which may be copper or any other suitable electrically-conductive material. In application of the dual contact ring 42, the outer voltage ring 44 contacts the annular edge region 61 of a wafer 60, as hereinafter described. An isolation ring 48, which may be asbestos, ceramic or other electrically-insulative material, is typically provided on the wafer 60 and fits in the outer ring center 46 of the outer voltage ring 44. An inner voltage ring 52, which is copper or other suitable electrically-conductive material, is provided on the wafer 60, inside the isolation ring interior 50. The patterned central region 62 of the wafer 60 is exposed through the inner ring center 54 of the inner voltage ring 52. Typically, the isolation ring 48 has a width of about 3-5 mm to prevent arcing of electrical current from the inner voltage ring 52 to the outer voltage ring 44 in application of the dual contact ring 42.

As further shown in FIG. 2, a positive voltage source 56 is electrically connected to the outer voltage ring 44, typically through outer ring wiring 57. In similar fashion, the current source 72 of the ECP system 70 (FIG. 4) is electrically connected to the inner voltage ring 52, through the wiring 98. In use of the dual contact ring 42 during an ECP process carried out on the wafer 60, as hereinafter described, the current source 72 of the ECP system 70 initially applies a negative voltage of from typically about −10 to about −20 volts to the inner voltage ring 52, which in turn imparts a negative electrical charge to the patterned central region 62 of the wafer 60, to electroplate metal from the electrolyte solution in the bath 80, onto the central region 62 of the wafer 60. The positive voltage source 56 then applies a positive voltage of typically from about +10 volts to about +20 volts to the outer voltage ring 44, which in turn imparts a positive electrical charge to the edge region 61 of the wafer 60. This positive charge removes electroplated metal from the edge region 61 of the wafer 60.

Figure 3:
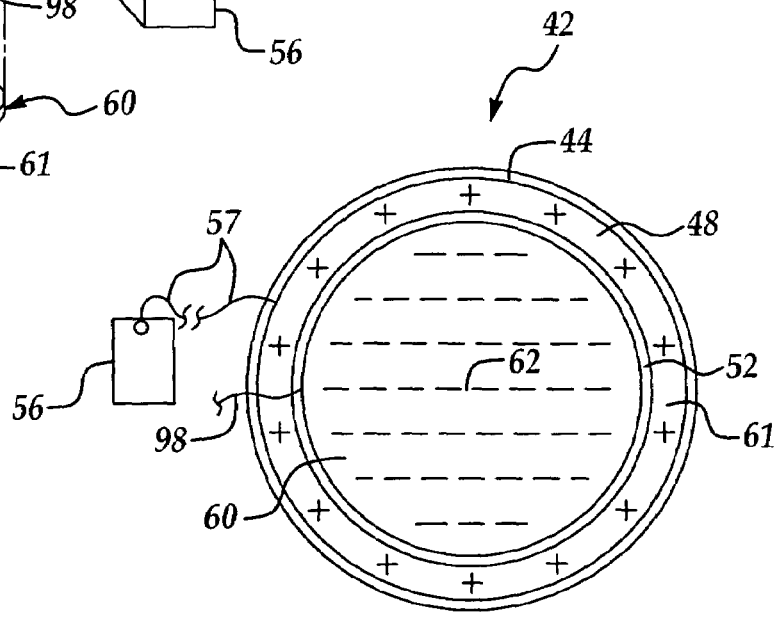
FIG. 3 is a top view of the dual contact ring of the present invention, in contact with a substrate and applying positive and negative voltages to the outer and inner regions, respectively, of the substrate in implementation of the present invention.
Figure 5:
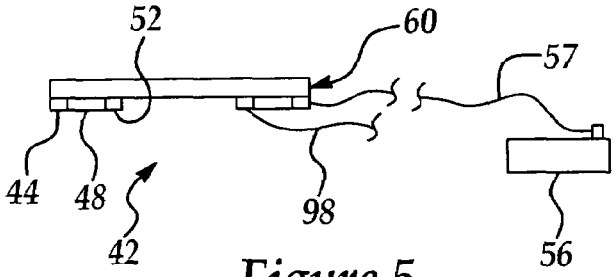
FIG. 5 is a cross-sectional view of a substrate, with the dual contact ring provided in contact with the substrate and connected to a voltage source in implementation of the present invention.

Referring next to FIGS. 3-5, in typical application of the dual contact ring 42, the outer voltage ring 44 is initially placed into contact with the edge region 61 of the wafer 60. The isolation ring 48 is then fitted inside the ring center 46 of the outer voltage ring 44, and the inner voltage ring 52 is fitted in the ring center 50 of the isolation ring 48. The inner voltage ring 52 is disposed in contact with the wafer 60 and encircles the patterned central region 62 thereof. Accordingly, the isolation ring 48 spans the concentric distance between the outer voltage ring 44 and the inner voltage ring 52, which distance is typically about 3-5 mm, and serves to electrically isolate the outer voltage ring 44 from the inner voltage ring 52. The outer voltage ring 44, the isolation ring 48 and the inner voltage ring 52 are held in place on the wafer 60 by the conventional cathode assembly (not shown) of the ECP system 70. Next, the dual contact ring 42 and the wafer 60 are immersed in the electrolyte bath 80 of the ECP system 70. The outer voltage ring 44 is electrically connected to the voltage source 56 typically through the outer ring wiring 57, and the inner voltage 52 is electrically connected to the current source 72 through the wiring 98.

Figure 6:
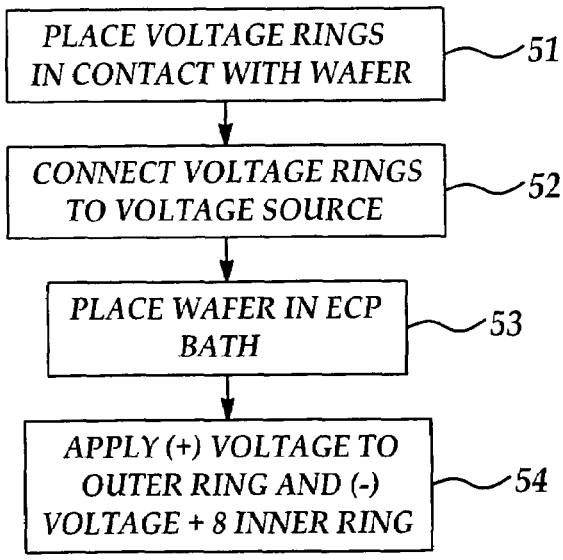
FIG. 6 is a flow diagram illustrating a typical sequence of process steps according to the method of the present invention.

Referring next to FIGS. 3-6, after the dual contact ring 42 is assembled on the wafer 60 as shown in step S1 of FIG. 6, the dual contact ring 42 is connected to the current source 72 and the positive voltage source 56 as shown in step S2 in FIG. 6, and the wafer 60 is immersed in the electrolyte bath 80 as shown in step S3 of FIG. 6, the electroplating system 70 is operated to electroplate the metal from the metal electrolyte solution in the bath 80, onto the wafer 60. Accordingly, the current source 72 applies a selected voltage potential typically at room temperature between the anode 76 and the cathode/wafer 60. This voltage potential creates an electric field around the anode 76 and the cathode/wafer 60, which electric field affects the distribution of the metal ions in the bath 80. In a typical copper electroplating application, a voltage potential of from typically about 10 volts to about 20 volts may be applied for about 2-8 minutes, and preferably, about 5 minutes, to the central region 62 of the substrate 60, through the inner voltage ring 52. Consequently, the metal is oxidized typically at the upper oxidizing surface of the anode 76 as electrons from the metal anode 76 reduce the ionic metal in the electrolyte solution bath 80 to form a substantially corrosion-resistant electroplated metal layer (not shown) at the interface between the cathode/wafer 60 and the electrolyte bath 80.

As the metal is electroplated onto the central region 62 of the wafer 60 as heretofore described, some of the metal is electroplated onto the outer or edge region 61 of the wafer 60. This metal electroplated onto the edge region 61 of the wafer 60 is removed as follows. A positive voltage of typically from about +10 volts to about +20 volts is applied by the positive voltage source 56 to the edge region 61 of the wafer 60, through the outer voltage ring 44, for a period of typically from about 5 minutes to about 10 minutes, and preferably, about 7 minutes. This positive charge oxidizes the electroplated metal at the edge region 61, causing the metal cations to re-enter the electrolyte solution in the electrolyte bath 80. In another embodiment, the positive voltage can be applied to the outer voltage ring 44 as the metal is electroplated onto the central region 62 of the wafer 60 to facilitate simultaneous electroplating of the metal onto the central region 62 and removal of the electroplated metal from the edge region 61 of the wafer 60. After this procedure is completed, the electroplated metal is limited to the central region 62 of the wafer 60. Accordingly, the wafer 60 need not be subjected to an IBC edge removal process after removal from the bath 80 and prior to subsequent semiconductor processing.

While the preferred embodiments of the invention have been described above, it will be recognized and understood that various modifications can be made in the invention and the appended claims are intended to cover all such modifications which may fall within the spirit and scope of the invention.

What is claimed is:

1. A dual contact ring for electroplating a metal on a substrate and removing the metal from a selected region on the substrate, comprising:

a first ring for contacting the substrate;

a negative voltage source electrically connected to said first ring for applying a negative voltage to said first ring;

a second ring for contacting the selected region on the substrate; and a positive or ground contact voltage source electrically connected to said second ring for applying a positive voltage to said second ring.

2. The dual contact ring of claim 1 wherein said first ring comprises an inner voltage ring for contacting a central region on the substrate and said second ring comprises an outer voltage ring for contacting an outer region on the substrate.

3. The dual contact ring of claim 1 further comprising an isolation ring interposed between said first ring and said second ring.

4. The dual contact ring of claim 3 wherein said first ring comprises an inner voltage ring for contacting a central region on the substrate and said second ring comprises an outer voltage ring for contacting an outer region on the substrate.

5. The dual contact ring of claim 3 wherein said isolation ring comprises asbestos.

6. The dual contact ring of claim 5 wherein said first ring comprises an inner voltage ring for contacting a central region on the substrate and said second ring comprises an outer voltage ring for contacting an outer region on the substrate.

7. The dual contact ring of claim 3 wherein said isolation ring has a width of about 3-5 mm.

8. The dual contact ring of claim 7 wherein said first ring comprises an inner voltage ring for contacting a central region on the substrate and said second ring comprises an outer voltage ring for contacting an outer region on the substrate.

9. A method of electroplating a metal on a substrate and removing the metal from a selected region on the substrate, comprising the steps of:

providing a first ring in contact with the substrate;

providing a second ring in contact with the selected region on the substrate;

electroplating the metal onto the substrate by applying a negative voltage to the substrate through said first ring; and removing the metal from the selected region on the substrate by applying a positive voltage or ground contact to the selected region on the substrate through said second ring.

10. The method of claim 9 wherein said first ring comprises an inner voltage ring for contacting a central region on the substrate and said second ring comprises an outer voltage ring for contacting an outer region on the substrate.

11. The method of claim 9 wherein said positive voltage is from about 10 volts to about 20 volts and said negative voltage is from about −10 to about −20 volts.

12. The method of claim 11 wherein said first ring comprises an inner voltage ring for contacting a central region on the substrate and said second ring comprises an outer voltage ring for contacting an outer region on the substrate.

13. The method of claim 9 wherein said applying a negative voltage to the substrate through said first ring comprises the step of applying said negative voltage to the substrate through said first ring for a period of from about 2 minutes to about 8 minutes.

14. The method of claim 13 wherein said first ring comprises an inner voltage ring for contacting a central region on the substrate and said second ring comprises an outer voltage ring for contacting an outer region on the substrate.

15. The method of claim 13 is from about 10 volts to about 20 volts and said negative voltage is from about −10 volts to about −20 volts.

16. The method of claim 9 wherein said applying a positive voltage to the selected region on the substrate through said second ring comprises the step of applying said positive voltage to the selected region on the substrate through said second ring for a period of from about 5 minutes to about 10 minutes.

17. The method of claim 16 wherein said first ring comprises an inner voltage ring for contacting a central region on the substrate and said second ring comprises an outer voltage ring for contacting an outer region on the substrate.

18. The method of claim 16 wherein said positive voltage is from about 10 volts to about 20 volts and said negative voltage is from about −10 to about −20 volts.

19. A method of electroplating a metal on a substrate and removing the metal from a selected region on the substrate, comprising the steps of:

providing a first ring in contact with the substrate;

providing a second ring in contact with the selected region on the substrate;

providing an isolation ring between said first ring and said second ring;

electroplating the metal onto the substrate by applying a negative voltage to the substrate through said first ring; and removing the metal from the selected region on the substrate by applying a positive voltage to the selected region on the substrate through said second ring.

20. The method of claim 19 wherein said first ring comprises an inner voltage ring for contacting a central region on the substrate and said second ring comprises an outer voltage ring for contacting an outer region on the substrate.

* * * * *